United States Patent [19]

Duckett

[11] Patent Number: 4,815,889

[45] Date of Patent: Mar. 28, 1989

[54] LANE BARRIER SYSTEM WITH PIVOT CONTROL AND METHOD

[75] Inventor: John W. Duckett, Tiburon, Calif.

[73] Assignee: Barrier Systems, Inc., Sausalito, Calif.

[21] Appl. No.: 219,319

[22] Filed: Jul. 15, 1988

[51] Int. Cl.[4] ..... E01F 13/00; E01F 9/00

[52] U.S. Cl. ..... 404/6; 404/10; 404/13; 256/13.1

[58] Field of Search ..... 404/6, 9, 10, 12, 13; 256/1, 13.1

[56] References Cited

U.S. PATENT DOCUMENTS

| | | | |
|---|---|---|---|
| 2,841,059 | 7/1958 | Wiswell | 404/13 |
| 3,531,823 | 10/1970 | Cornelius | 16/361 |
| 4,105,353 | 8/1978 | Bork et al. | 404/6 X |
| 4,376,594 | 3/1983 | Prosenz | 404/6 |
| 4,435,106 | 3/1984 | Forster et al. | 404/6 |
| 4,474,503 | 10/1984 | Booth et al. | 404/6 |
| 4,496,264 | 1/1985 | Casey | 404/6 |
| 4,498,803 | 2/1985 | Quittner | 404/6 |
| 4,500,225 | 2/1985 | Quittner | 404/13 X |
| 4,502,812 | 3/1985 | Zucker | 404/6 |
| 4,539,727 | 9/1985 | Mautner et al. | 16/285 |
| 4,547,929 | 10/1985 | Lew et al. | 16/361 X |
| 4,624,601 | 11/1986 | Quittner | 404/6 X |
| 4,661,010 | 4/1987 | Almer et al. | 404/6 |
| 4,666,332 | 5/1987 | Burgett | 404/6 |

FOREIGN PATENT DOCUMENTS

| | | | |
|---|---|---|---|
| 559969 | 7/1958 | Canada | 404/12 |
| 431594 | 8/1967 | Switzerland | 256/13.1 |

*Primary Examiner*—Jerome W. Massie, IV
*Assistant Examiner*—John F. Letchford
*Attorney, Agent, or Firm*—Phillips, Moore, Lempio & Finley

[57] ABSTRACT

A lane barrier system comprises a plurality of pivotally interconnected modules adapted to be transferred on a roadway. Each adjacent pair of modules are pivotally connected together by hinge connections to permit the modules to pivot relative to each other about a vertical pivot axis. A pivot control connected to at least one of the hinge connections permits the pivot axis to move between the modules whereby the modules are capable of elongating or contracting to assume a composite varied length. The pivot control further functions to fix the position of the pivot axis between the modules to rigidify the lane barrier system longitudinally and to place it in tension when lateral loads are imposed thereon, such as when impacted by a road vehicle. The ability of the lane barrier system to elongate or contract is advantageous when the system is picked-up by a transfer vehicle for relocation on a roadway and when the system is positioned at various radii on a curved roadway. In the disclosed embodiment of this invention, the pivot control is responsive to lifting of the modules from a roadway to place them in condition permitting them to elongate or contract.

22 Claims, 2 Drawing Sheets

LANE BARRIER SYSTEM WITH PIVOT CONTROL AND METHOD

TECHNICAL FIELD

This invention relates to a lane barrier system for roadways and more particularly to a transferable lane barrier having a plurality of pivotally interconnected modules adapted to be lifted and moved to various locations on a roadway or the like by a transfer vehicle.

BACKGROUND OF THE INVENTION

U.S. Pat. Nos. 4,498,803, 4,500,225, and 4,624,601 disclose a transferable lane barrier system for roadways adapted to be lifted by a transfer vehicle and moved to a selected position on a roadway or the like. Lane barrier systems of this type find particular application at roadway construction sites and on roadways and bridges wherein the groupings of incoming and outgoing lanes of traffic must be varied, particularly during commute hours.

Applicant's co-pending U.S. patent application Ser. No. 196,435, filed on May 20, 1988 for "Anti-Crash Lane Barrier With Self-Centering Hinges" and U.S. patent application Ser. No. 219,320, filed on July 15, 1988 for "Pre-Loaded Hinges For Lane Barrier System" disclose systems with the ability to elongate or contract to accommodate positioning of the system varied radii on a curved roadway. Further, such elongation and contraction is advantageous when the lane barrier system is picked-up by a transfer vehicle to ready it for placement at a new position on a roadway.

The former application also addresses the problem of providing an effective lane barrier system to prevent head-on collisions and the like. For example, the Golden Gate Bridge in San Francisco and its connector, Doyle Drive, are even now using upstanding plastic posts having pins secured on their lower ends to facilitate transfer of the posts from lane to lane to accommodate changes in commute hour traffic. This system has proved inadequate for protecting against head-on collisions, as evidenced by four fatalities and numerous injuries that have occurred during the first four months of 1988.

Applicant has determined that it would be advantageous to provide a lane barrier system with the capability of being placed in tension when impacted by lateral loads such as when impacted by a road vehicle. Further, it is highly desirable to retain the capability of permitting the modules to elongate or contract for purposes described above.

SUMMARY OF THE INVENTION

An object of this invention is to provide an improved lane barrier system for roadways and the like that overcomes the above, briefly described problems.

The lane barrier system comprises at least one pair of upstanding modules disposed in closely spaced and tandem relationship relative to each other to normally assume a composite nominal length. The modules are pivotally connected together for relative pivotal movement about a vertical pivot axis and pivot control means are provided for: (1) Permitting the pivot axis to move between the modules and the modules to elongate or contract to assume a composite varied length different than their nominal length; or (2) Fixing the position of the pivot axis between the modules for rigidifying the lane barrier system longitudinally to place it in tension when lateral impact loads are imposed thereon.

In the preferred embodiment of this invention, the pivot control means permits the pivot axis to move between the modules when the modules are lifted from a roadway or the like and for fixing the position of the pivot axis between the modules when the modules are deposited on the roadway.

In carrying forth the method steps of this invention, the lane barrier system is positioned on a roadway to simultaneously fix the position of the pivot axis between the modules for rigidifying the system longitudinally and lifting the lane barrier system over the roadway and simultaneously permitting the pivot axis to move between the modules to enable the system to elongate or contract.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
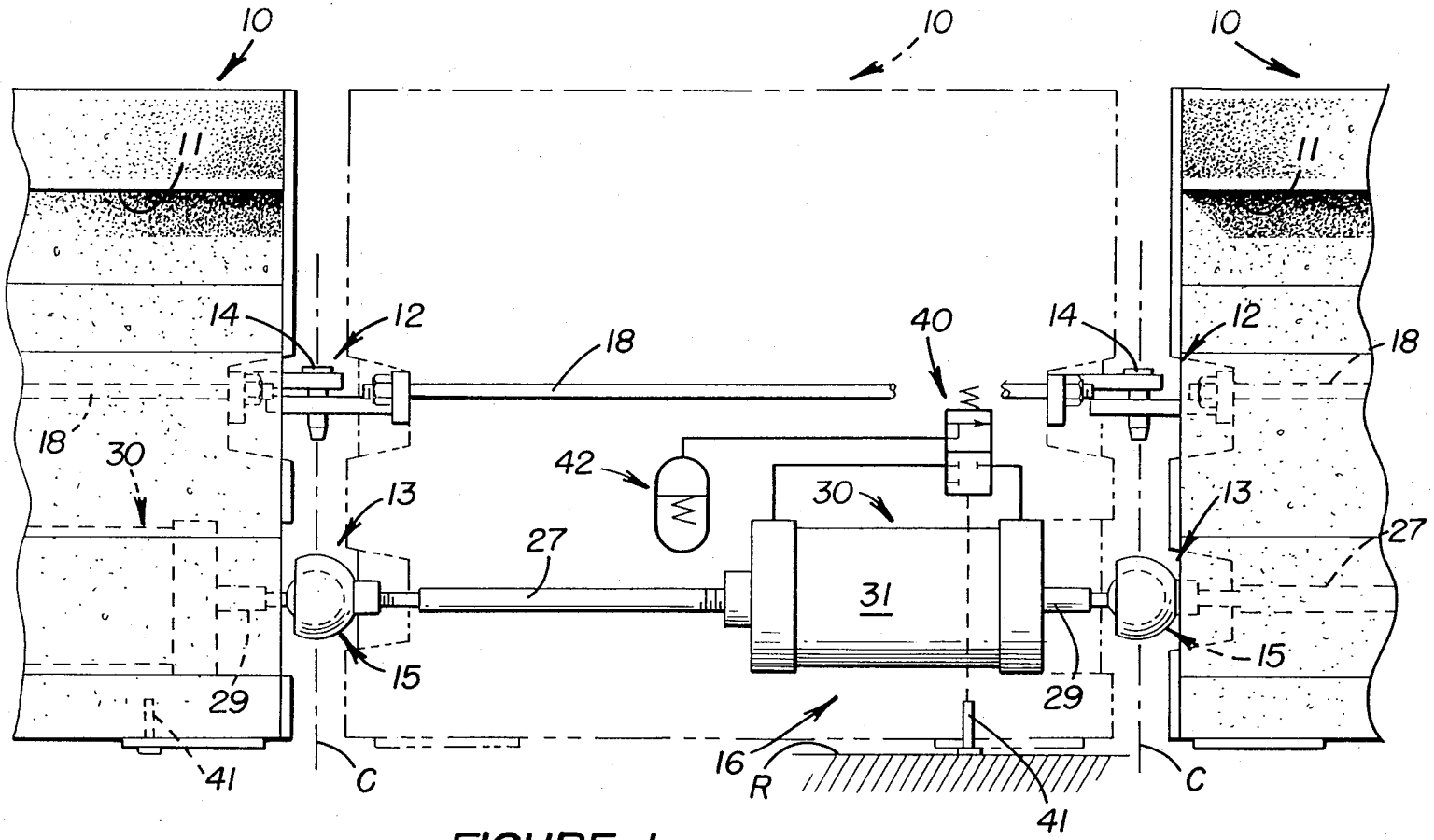
FIG. 1 is a side elevational view partially illustrating a lane barrier system including three interconnected modules and a hinge connection between each adjacent pair of modules.

FIG. 1 partially illustrates a lane barrier system comprising a plurality of identical modules 10 adapted for use in the manner described in above-referenced U.S. Pat. Nos. 4,498,803, 4,500,225, and 4,624,601. As described in these patents, the lane barrier system is adapted to be transferred from a first position to a laterally displaced second position at a construction site or on a roadway to delineate and provide an anti-crash barrier between lanes thereof.

In particular, the wheeled road vehicle (not shown) has a transfer mechanism mounted thereon whereby the lane barrier system can be moved in serpentine and chain-like fashion from one side of the vehicle to its other side for repositioning the system to a new location on a roadway. Since the vehicle and transfer mechanism, as well as the method for moving the system, do not form a direct part of this invention, further detailed discussions thereon are deemed unnecessary for a full understanding of this invention.

Each module 10 includes a steel reinforced concrete casting with one commercial embodiment of the module weighing approximately 1400 lbs. Such casting has a height of 32.0 in., a base width of 24.0 in., a top width of 12.56 in., and a length of 37.0 in. As further described in the above-referenced patents, when viewed in cross-section, each module has a T-shaped upper end defining a pair of undercut surfaces 11 on opposite sides of each module.

The longitudinally aligned undercut surfaces of the modules provide transfer means formed in unobstructed relationship on lateral sides of each module and longitudinally throughout the entire lengths thereof with the undercut surfaces being adapted to engage over and be lifted by rollers of a transfer mechanism of the type referenced above. The modules are hingedly connected together, as described hereinafter, to enable the modules to be lifted from a first position on a roadway, moved serpentine-like and generally transversely across the vehicle and deposited at a second location on a roadway and on the other side of the vehicle.

As further shown in FIG. 1, each pair of adjacent modules are disposed in closely spaced and tandem relationship relative to each other and are hingedly connected together for relative pivotal movement about a vertically disposed pivot axis C. Each hinge connection comprises an upper hinge 12 and a lower hinge 13, described more fully hereinafter. In the illustrated embodiment, the upper hinge comprises a hinge pin 14 and the lower hinge comprises a universal joint, shown in the form of a ball and socket connection 15.

Figure 2:
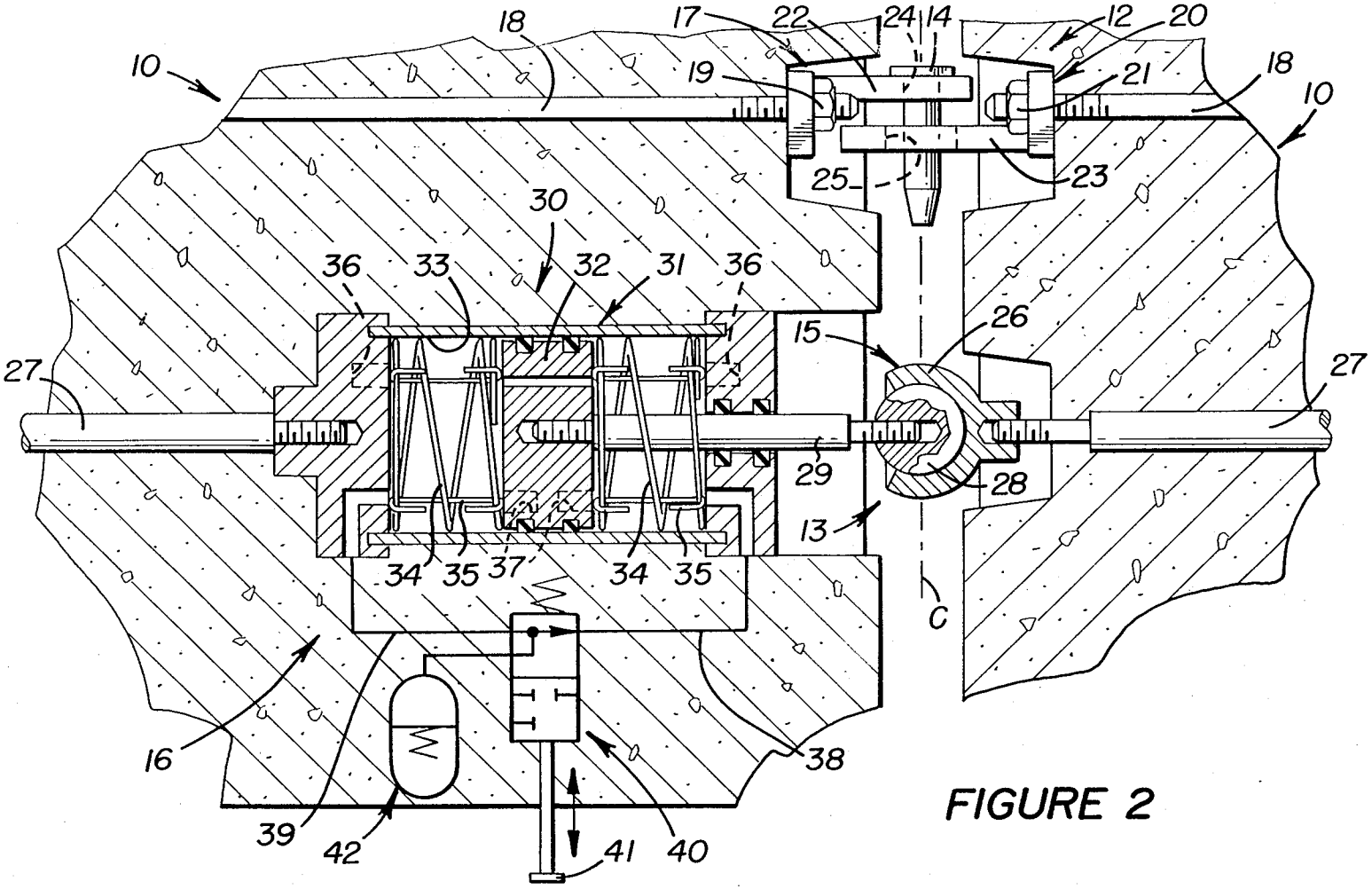
FIG. 2 is an enlarged and sectional view illustrating the hinge connection between a pair of modules and a pivot control means therefor.

A pivot control means 16 is connected to ball and socket 15 for: (1) Permitting pivot axis C to move longitudinally between the modules and the modules to elongate or contract to assume a composite varied length different than their nominal length illustrated in FIG. 1; or (2) Fixing the position of the pivot axis between the modules for rigidifying the lane barrier system longitudinally to place it in tension when lateral impact loads are imposed thereon, such as by a motor vehicle. In the illustrated embodiment, the pivot control means is responsive to its relative position on a roadway R whereby when the lane barrier system is positioned on the roadway, pivot axis C will be fixed between the modules to rigidify the system longitudinally and place it in tension when a lateral load is imposed thereon (FIG. 1) and when the system is lifted over the roadway for transfer purposes, the pivot axis is permitted to move between the modules to enable the system to elongate or contract to assume a composite varied length different than its nominal length (FIG. 2). As described above, the ability of the system to elongate or contract facilitates movement of the system through a transfer vehicle and further facilitates positioning of the system at varied radii on a curved roadway.

Upper hinge 12 comprises a bracket 17 mounted on the threaded ends of a pair of laterally spaced upper tie rods 18 (one shown) by nuts 19. The tie rods extend longitudinally through each module with the opposite, threaded ends of the tie rods having a second bracket 20 of the upper hinge secured thereon by nuts 21. Bracket 17 has a hinge plate 22 extending outwardly therefrom to overly a hinge plate 23 of bracket 20.

A cylindrical hole 24 is formed vertically through hinge plate 22 to normally overly the center of an elongated slot 25, formed through hinge plate 23. The hinge pin 14 is closely fitted within hole 24 and is allowed limited reciprocation within slot 25, upon elongation or contraction of the lane barrier system. As described in detail hereinafter, pivot control means 16 further functions to automatically return pivot axis C and the modules to their nominal positions, illustrated in FIGS. 1 and 2, when the load imposed on the modules to elongate or contract them is removed from the system.

Ball and socket 15 of lower hinge 13 is standard and comprises a socket 26 suitably secured to one threaded end of single tie rod 27 also extending longitudinally through each module. A ball 28 of the connection is secured to the distal end of a rod 29, forming part of a double-acting hydraulic cylinder 30. As described more fully hereinafter, the rod of the cylinder is adapted to extend and retract automatically when the lane barrier system is lifted from a roadway (FIG. 2) and for being locked against extension or retraction when the lane barrier is deposited on the roadway (FIG. 1).

Cylinder 30 further comprises a cylindrical housing 31 mounted in each module and piston 32 reciprocally mounted in a chamber 33 of the housing. The piston thus defines a chamber on either side thereof with the proximal end of rod 29 extending through the housing and attached to one side of the piston.

A compression coil spring 34 is mounted in th chamber on each side of the piston to center the piston in the housing when fluid pressures are equalized on either side of the piston. A standard stop wire 35 is hooked-over the end coils of each spring to delimit the expansion thereof. Blind bores 36 and 37 are suitably formed in housing 31 and piston 32, respectively, to accommodate the ends of wires 35 when the springs are compressed.

Lines 38 and 39 connect a valve 40 to the chambers defined on either side of piston 32 to intercommunicate the chambers with each other when modules 10 are lifted from the roadway, as illustrated in FIG. 2. Spring-biased valve 40 is biased to its open position illustrated in FIG. 2 and further biased to a closed position illustrated in FIG. 1 when a trip rod 41 thereof engages roadway R (FIG. 1). An accumulator 42 intercommunicates with the chambers of cylinder 30 on opposite sides of piston 32 when spring-biased valve 40 returns to its open position illustrated in FIG. 2 when the respective module is lifted over the roadway.

It should be understood that the pivot control means comprising cylinder 30 could be used with both hinges 12 and 13 or with only one of the hinges. Further, other types of hinges could be substituted for ball and socket connection 15, such as a pair of overlying hinge plates (similar to hinge plate 22) secured to the ends of rods 27 of the adjacent modules. In the latter hinge connection, hinge pin 11 could be extended through aligned holes formed through the hinge plates. As will be appreciated by those skilled in the art, valve 40 could be "tripped" in other manners, such as by actuating the valve to its FIG. 2 open position when engaged with a trip member mounted on the transfer mechanism and spring-biasing it to its closed position, illustrated in FIG. 1, when the lane barrier system is deposited on a roadway.

I claim:

1. A lane barrier system comprising at least on pair of upstanding first and second modules disposed in closely spaced and tandem relationship relative to each other to normally assume a composite nominal length, pivot means connecting said modules together for relative pivotal movement about a vertical pivot axis having a nominal position between said modules, and pivot control means confined entirely within said modules for: (1) Permitting said pivot axis to move between said modules and said modules to elongate or contract to assume a composite varied length different than said nominal length or (2) Fixing the position of said pivot axis between said modules for rigidifying said lane barrier system longitudinally when a load is imposed on said lane barrier system.

2. The lane barrier system of claim 1 wherein said pivot control means further comprises means for automatically returning said pivot axis and said modules to their nominal positions when said load is removed from said lane barrier system.

3. The lane barrier system of claim 1 further comprising transfer means formed on said modules for receiving and engaging a transfer apparatus to enable said modules to be lifted from a first position on a roadway and deposited at a second position on said roadway, said pivot control means responsive to permit said pivot axis to move when said modules are lifted and to fix the position of said pivot axis between said modules when said modules are deposited.

4. The lane barrier system of claim 3 wherein said pivot control means comprises cylinder means for being extended or retracted automatically when said lane barrier system is lifted and for being locked against extension or retraction when said lane barrier system is deposited.

5. The lane barrier system of claim 4 wherein said pivot means comprises vertically spaced first and second hinges and wherein said cylinder means is connected to at least one of said first and second hinges.

6. The lane barrier system of claim 5 wherein said first hinge comprises a cylindrical hinge pin having a predetermined diameter, a first hinge plate secured to said first module and having a vertically disposed hole formed therethrough substantially conforming in diameter to said hinge pin and a second hinge plate secured to said second module in vertical alignment with said first hinge plate and having an elongated slot formed therethrough that is larger than the diameter of said hinge pin and wherein said hinge pin extends through said hole and said slot and said cylinder means is connected to said second hinge.

7. The lane barrier system of claim 6 wherein said second hinge comprises a universal joint.

8. A lane barrier system of claim 7 wherein said universal joint comprises a ball and socket connection.

9. The lane barrier system of claim 4 wherein said pivot control means further comprises valve means connected to said cylinder means for permitting said cylinder means to extend and retract automatically when said lane barrier system is lifted and to lock said cylinder means against extension or retraction when said lane barrier system is deposited.

10. The lane barrier system of claim 4 wherein said cylinder means comprises a housing mounted in said first module, a piston reciprocally mounted in said housing to define an expansible chamber on either side thereof and a rod secured to said piston for simultaneous reciprocation therewith.

11. The lane barrier system of claim 10 wherein said cylinder means further comprises spring means mounted in each chamber of said housing for normally biasing said piston to a nominal position therein when said pivot control means permits said pivot axis to move between said modules.

12. The lane barrier system of claim 10 wherein said pivot control means further comprises accumulator means connected to said housing and communicating with each said chamber on either side of said piston for receiving and storing pressurized fluid therein.

13. The lane barrier system of claim 12 wherein said pivot control means further comprises valve means connected to said accumulator means and to said cylinder means for permitting said cylinder means to extend and retract automatically and to communicate said accumulator means with each chamber of said cylinder means when said lane barrier system is lifted and for locking said cylinder means against extension or retraction and to block communication of said accumulator means with each chamber of said cylinder means when said lane barrier system is deposited.

14. A lane barrier system comprising at least one pair of upstanding first and second modules disposed in closely spaced and tandem relationship relative to each other to normally assume a composite nominal length, transfer means formed on said modules for receiving and engaging a transfer apparatus to enable said modules to be lifted from a first position on a roadway and deposited at a second position on said roadway, pivot means connecting said modules together for relative pivotal movement about a vertical pivot axis, and pivot extendable and retractable control means for permitting said pivot axis to move between said modules when said modules are lifted and for fixing the position of said pivot axis between said modules for rigidifying said lane barrier system longitudinally when said modules are deposited to place said system in tension when lateral impact loads are imposed thereon.

15. The lane barrier system of claim 14 wherein said pivot control means comprises cylinder means for being extended and retracted automatically when said lane barrier system is lifted and for being locked against extension or retraction when said lane barrier system is deposited.

16. The lane barrier system of claim 15 wherein said pivot means comprises vertically spaced first and second hinges and wherein said cylinder means is connected to at least one of said first and second hinges.

17. The lane barrier system of claim 16 wherein said first hinge comprises a cylindrical hinge pin having a predetermined diameter, a first hinge plate secured to said first module and having a vertically disposed hole formed therethrough substantially conforming in diameter to said hinge pin and a second hinge plate secured to said second module in vertical alignment with said first hinge plate and having an elongated slot formed therethrough that is larger than the diameter of said hinge pin and wherein said hinge pin extends through said hole and said slot and said cylinder means is connected to said second hinge.

18. The lane barrier system of claim 17 wherein said second hinge comprises a universal joint.

19. The lane barrier system of claim 15 wherein said pivot control means further comprises valve means connected to said cylinder means for permitting said cylinder means to extend and retract automatically when said lane barrier system is lifted and to lock said cylinder means against extension or retraction when said lane barrier system is deposited.

20. The lane barrier system of claim 19 wherein said cylinder means comprises a housing mounted in said first module, a piston reciprocally mounted in said housing to define a chamber on either side thereof and a rod secured to said piston for simultaneous reciprocation therewith.

21. The lane barrier system of claim 20 wherein said cylinder means further comprises spring means mounted in each chamber of said housing for normally biasing said piston to a nominal position therein when said pivot control means permits said pivot axis to move between said modules and further comprising accumulator means, connected to each said chamber, for receiving and storing pressurized fluid therein.

22. A method for controlling the tensioning of a lane barrier system comprising at least one pair of upstanding first and second modules disposed in closely spaced and tandem relationship relative to each other to normally assume a composite nominal length and pivot means connecting said modules together for relative pivotal movement about a vertical pivot axis, said method comprising the steps of providing a pivot control means entirely within said modules positioning said lane barrier system on a roadway and simultaneously operating said pivot control means for fixing the position of said pivot axis between said modules for rigidifying said system longitudinally to place said system in tension when lateral loads are imposed thereon, and lifting said lane barrier system over said roadway and simultaneously operating said pivot control means of permitting said pivot axis to move between said modules to enable said system to elongate or contract to assume a composite varied length different than said nominal length.

* * * * *